US006070534A

United States Patent [19]

Lehrieder

[11] Patent Number: 6,070,534

[45] **Date of Patent: *Jun. 6, 2000**

[54] CONVEYING SYSTEM

[75] Inventor: Erwin Paul Josef Lehrieder, Gaukönigshofen, Germany

[73] Assignee: Koenig & Bauer-Albert Aktiengesellschaft, Wurzburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/805,848

[22] Filed: Mar. 3, 1997

[30] Foreign Application Priority Data

Mar. 2, 1996 [DE] Germany ..... 196 08 133

[51] Int. Cl.[7] ..... B61B 13/12; B65G 19/02; B65G 35/06

[52] U.S. Cl. ..... 104/172.3; 104/172.2; 104/130.09; 105/29.1; 198/465.1

[58] Field of Search ..... 198/465.1, 803.14; 104/172.2, 172.3, 130.09; 105/29.1

[56] References Cited

U.S. PATENT DOCUMENTS

| | | | |
|---|---|---|---|
| 2,619,916 | 12/1952 | Raimier | 104/172.3 |
| 2,965,043 | 12/1960 | Klamp et al. | 104/172.3 |
| 3,461,812 | 8/1969 | Roland | 104/172.2 |
| 3,552,322 | 1/1971 | Clowes | 104/172.3 |
| 3,566,802 | 3/1971 | Lundgvist | 104/172.3 |
| 3,581,670 | 6/1971 | Larivee | 104/172.2 |
| 3,774,545 | 11/1973 | Karlstrom | 198/850 |
| 3,874,304 | 4/1975 | Robert . | |
| 3,902,430 | 9/1975 | Ott et al. | 104/172.2 |
| 3,949,859 | 4/1976 | Nussbaumer et al. | 104/172.2 |
| 3,986,458 | 10/1976 | Kling . | |
| 4,088,220 | 5/1978 | Jacksch et al. . | |
| 4,211,172 | 7/1980 | Chapman et al. | 104/172.2 |
| 4,246,847 | 1/1981 | Chapman et al. | 104/172.2 |
| 4,461,379 | 7/1984 | Papp | 104/172.3 X |
| 4,483,252 | 11/1984 | Pierson . | |
| 4,563,956 | 1/1986 | Wiechert et al. . | |
| 4,757,893 | 7/1988 | Shabram, Jr. et al. . | |
| 5,388,684 | 2/1995 | Peck . | |
| 5,549,050 | 8/1996 | Rhodes | 104/172.3 |

FOREIGN PATENT DOCUMENTS

| | | | |
|---|---|---|---|
| 0 087 023 | 8/1983 | European Pat. Off. . | |
| 0 288 730 | 11/1988 | European Pat. Off. . | |
| 0 316 990 | 5/1989 | European Pat. Off. . | |
| 0 337 891 | 10/1989 | European Pat. Off. . | |
| 0 424 563 | 5/1991 | European Pat. Off. . | |
| 0 462 878 | 12/1991 | European Pat. Off. . | |
| 0 587 015 | 8/1993 | European Pat. Off. . | |
| 1232219 | 10/1960 | France | 104/172.2 |
| 2 581 046 | 10/1986 | France . | |
| 1 100 554 | 2/1961 | Germany . | |
| 1 192 103 | 4/1965 | Germany . | |
| 41 185 | 11/1965 | Germany . | |
| 1 289 781 | 2/1969 | Germany . | |
| 1 925 193 | 11/1969 | Germany . | |
| 2 044 504 | 3/1971 | Germany . | |
| 2 049 053 | 10/1971 | Germany . | |
| 2 121 087 | 12/1971 | Germany . | |
| 1 965 686 | 5/1973 | Germany . | |
| 7330285 | 2/1974 | Germany . | |
| 2 253 718 | 6/1974 | Germany . | |
| 2 306 712 | 8/1974 | Germany . | |
| 22 09 053 | 10/1975 | Germany . | |
| 24 13 653 | 10/1975 | Germany . | |
| 24 31 244 | 12/1975 | Germany . | |
| 25 22 299 | 12/1976 | Germany . | |
| 2622813 | 1/1977 | Germany | 198/465.1 |

(List continued on next page.)

*Primary Examiner*—Robert P. Olszewski
*Assistant Examiner*—Thuy V. Tran
*Attorney, Agent, or Firm*—Jones, Tullar & Cooper, P.C.

[57] ABSTRACT

A conveying system for transporting loads utilizes a transport cart that is supported by rollers. The transport cart is supported by the rollers adjacent several serially arranged revolving drives that each have a plurality of spaced recesses. At least one pusher is carried by the cart and engages a recess in the drive. The cart can be halted, if its path is blocked, by disengagement of the pusher from the recess in the drive.

4 Claims, 7 Drawing Sheets

FOREIGN PATENT DOCUMENTS

| | | | |
|---|---|---|---|
| 28 18 715 | 11/1979 | Germany . | |
| 32 01 823 | 7/1983 | Germany . | |
| 33 30 313 | 3/1984 | Germany . | |
| 32 43 914 | 5/1984 | Germany . | |
| 33 04 568 | 8/1984 | Germany . | |
| 34 15 704 | 11/1984 | Germany . | |
| 33 30 620 | 3/1985 | Germany . | |
| 35 13 535 | 10/1986 | Germany . | |
| 36 09 751 | 10/1987 | Germany . | |
| 37 07 395 | 3/1988 | Germany . | |
| 38 04 593 | 6/1989 | Germany . | |
| 38 05 712 | 9/1989 | Germany . | |
| 88 12 338 | 3/1990 | Germany . | |
| 195 16 775 | 11/1995 | Germany . | |
| 47-30078 | 11/1972 | Japan . | |
| 54-129676 | 10/1979 | Japan | 104/172.2 |
| 59-78317 | 5/1984 | Japan . | |
| 60-174662 | 11/1985 | Japan . | |
| 1-65215 | 4/1989 | Japan . | |
| 7-41970 | 10/1995 | Japan . | |
| 899403 | 1/1982 | U.S.S.R. | 104/172.3 |

CONVEYING SYSTEM

FIELD OF THE INVENTION

The present invention is directed generally to a conveying system. More particularly, the present invention is directed to a conveying system for use in transporting loads supported on a load receiver. Most specifically, the present invention is directed to a conveying system for transporting loads supported on a transport cart provided with rollers and moved by a subsurface drive. This drive includes a plurality of endless drive belts or chains that are located in a subsurface trough. The transport cart is supported on rollers or wheels that are situated in guide channels that define the subsurface trough. Downwardly extending pushers or drive elements depend from the transport card and are engageable with the endless drive belts or chains. The drive elements are disengageable from the drive chains in the event of a blockage of the travel path of the transport cart.

DESCRIPTION OF THE PRIOR ART

In many industrial situations, it is desirable to be able to transport various loads from one point to another point by the use of transport carts that move along a surface, such as a floor. One way to accomplish this is to place the load onto a cart that is then guided by a human operator. Such a transport scheme becomes expensive especially in the situation where the task is repeated frequently and where the transport path is always the same. In order to eliminate the need for a human operator, various systems of guided transport carts, that do not require the assistance of a human operator, have been developed.

One such conveying system for transporting loads is disclosed in German Patent Publication DE 33 04 568 C2. This prior art conveying system essentially consists of a transport cart moving on a guide path and being driven by revolving chains. Two chain wheels, which engage the chains, are seated on the transport cart and drive the transport cart in the movement direction of the chains. For a trouble-free transition from a first to a second drive chain, these chain wheels are seated so that they are resiliently pivotable over a limited pivot angle with respect to the transport cart. A limitation of this prior conveying system is the absence of any safety devices that will operate to disconnect the transport cart from the revolving chains if the transport cart should encounter an obstacle along the path of travel.

The European Patent Publication EP 0 587 015 A1 describes a conveying installation which uses a transport cart that runs on a rail system. This transport cart utilizes two pairs of running wheels. The cart in this prior art device is driven by a revolving double chain assembly against which a friction bar, that is connected to the cart, presses. In this prior conveying installation, the frictional connection between the chain and the cart, which is in the nature of a sliding coupling, does not provide a uniform, steady coefficient of friction. The coefficient of friction between the chain drive and the friction bar varies as a result of oil and dirt that become attached either to the chain or to the sliding coupling. The function of this sliding coupling, both as a drive connection, and also as a releasable overload coupling, is not completely assured and is thus not completely satisfactory.

It will be seen that a need exists for a conveying arrangement for transport carts that overcomes the limitations of the prior art. The conveying system in accordance with the present invention provides such an arrangement and is a significant improvement over the prior art.

SUMMARY OF THE INVENTION

It is an object of the present invention to provide a conveying system.

Another object of the present invention is to provide a conveying system that uses transport carts.

A further object of the present invention is to provide a conveying system for conveying loads supported by transport carts that are driven by endless drive belts or chains.

Yet another object of the present invention is to provide a conveying system having a subsurface trough within which endless drive chains are positioned.

Still a further object of the present invention is to provide a conveying device in which the transport carts are releasably engageable with the endless drive chains.

Even yet another object of the present invention is to provide a conveying device having one or more pushers carried by each transport cart.

As will be discussed in detail in the description of the preferred embodiments, which is set forth in detail subsequently, the conveying system in accordance with the present invention utilizes one or more transport carts, each of which is intended to support and to transport a load. A trough is formed beneath a support surface, such as the floor, above which the transport carts move. This trough is provided with a plurality of serially arranged revolving drives that are typically endless chains or toothed belts which are supported by toothed sprockets or by drive wheels. A pair of guide channels flank these revolving drives in the subsurface trough and receive rollers that are attached to the transport carts. Each cart is provided with one or more so-called pushers or drive connections that are engageable with the endless drives. These pushers, or drive connections are releasable from the drives if the transport cart should encounter an obstacle along its path of travel. The pushers may also be disengageable from the drives if it is desired to hold the transport cart stationary for a period of time.

A primary advantage of the present invention is the prevention of damage to either the transport cart and its contents, or to an obstacle which the cart may encounter along its transport path due to the disengageable relationship between the revolving drives and the one or more pushers or drive connections on each transport cart. In the event of the cart's encountering of such an obstacle, the pushers act as sliding couplings and allow the drive coupling between the cart and the chain to become disconnected.

Typically each transport cart will be provided with two longitudinally spaced pushers. The spacing distance between each two pushers will be greater than the spacing distance between end or reversing wheels or sprockets for adjacent endless drive belts or chains. This allows each transport cart to transition between serially arranged endless drives whether the transport cart is moving forwardly or rearwardly. In an alternate configuration, each cart can have a single elongated pusher whose length is greater than the spacing distance between adjacent end or reversing wheels or sprockets.

The pusher or pushers on each transport cart are resiliently mounted and are urged into engagement with the drive chains or belts by springs. The spring forces of these springs can be varied by the selection of different springs. This will effectively control the force with which the pushers engage the revolving drives and will also set the release force which, when exceeded, will effectively disconnect the transport carts from the endless drives. The distance between each two pushers on a transport cart can be set in accordance with the pitch or aperture spacing of a drive chain or belt. This will reduce the load forces on an individual pusher since each pusher will be in engagement with the drive chain or belt.

When the drive is being accomplished by the use of an endless, toothed belt, it is advantageous to provide the pusher or pushers as segments of the toothed belt. This will insure a multiple tooth engagement between the pusher or pushers and the drive. Such an engagement will spread out the load imposed on each tooth.

The conveying system in accordance with the present invention overcomes the limitations of the prior art devices. It is a substantial advance in the art.

BRIEF DESCRIPTION OF THE DRAWINGS

While the novel features of the conveying system in accordance with the present invention are set forth with particularity in the appended claims, a full and complete understanding of the invention may be had by referring to the detailed description of the preferred embodiments, which is presented subsequently, and as illustrated in the accompanying drawings, in which:

DETAILED DESCRIPTION OF THE PREFERRED EMBODIMENTS

Figure 1:
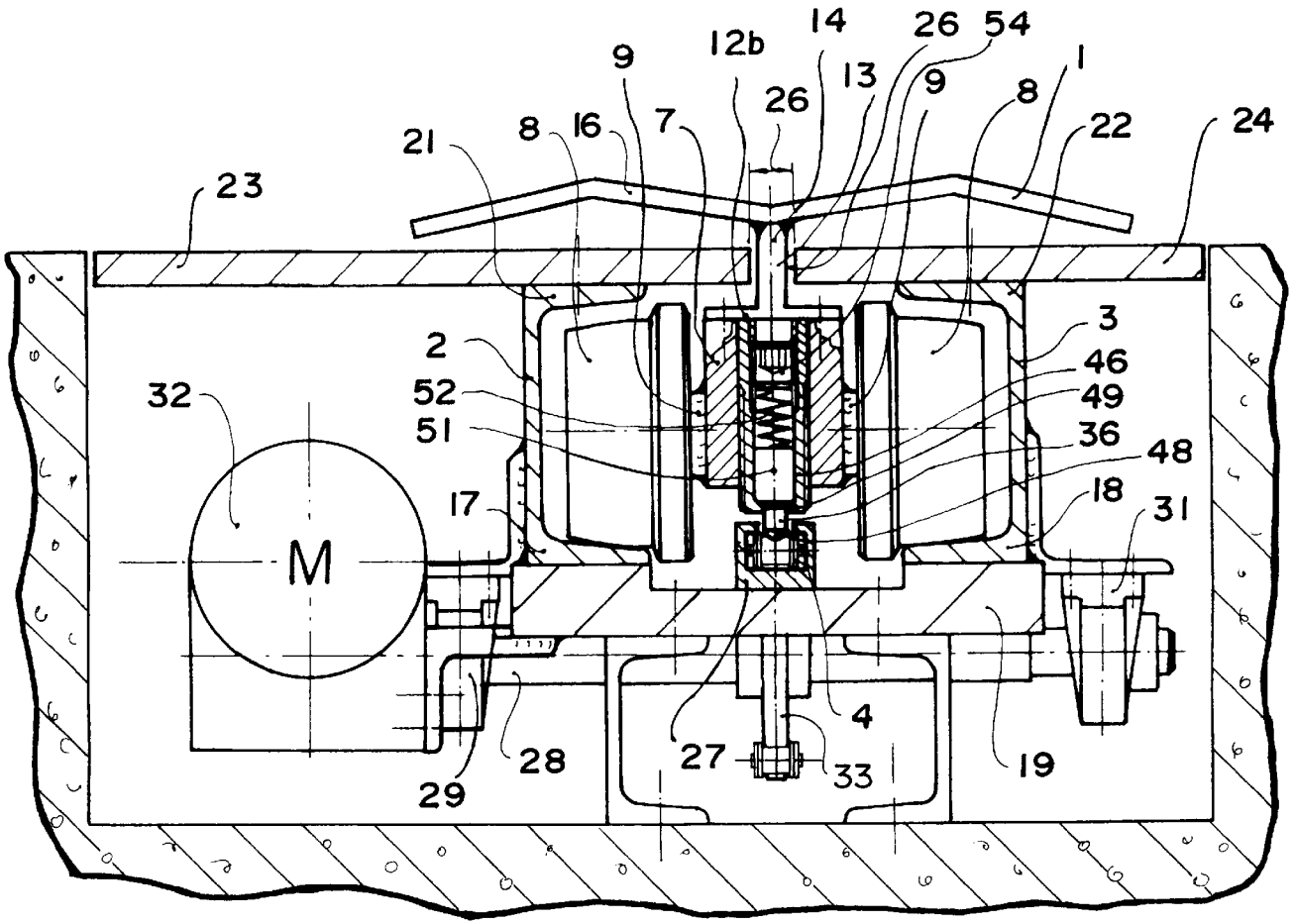
FIG. 1 is a schematic end view, partly in cross-section of a conveying device in accordance with the present invention and taken in the conveying direction T, as shown in FIGS. 2–7.

Referring initially to FIG. 1, and taken in conjunction with FIGS. 2–7, there may be seen a conveying system in accordance with the present invention. This conveying system includes a transport cart 1 which is usable to transport a variety of loads. In a preferred configuration, the transport cart 1 is usable to transport rolls of paper to and away from a web-fed rotary printing press. As seen in FIG. 1, the conveying system includes the transport cart 1, a pair of subsurface guides 2 and 3 which define the path of travel of the transport cart 1, and a plurality of serially arranged rotating drive means 4 and 6 which are provided with recesses.

The transport cart 1 includes an undercarriage, generally at 7, and a load receiver, generally at 16. The undercarriage 7 is generally in the shape of an inverted U, as seen in cross-section in FIG. 1, and supports four laterally extending, spaced, opposed rollers 8. These rollers 8 are supported on cooperating journals 9 that are, in turn, joined to the transport cart undercarriage 7. As may be seen most clearly in FIG. 1, these rollers 8 ride in, and are supported by the guides 2 and 3 with these guides being in the form of generally C-shaped channels and forming sidewalls of the subsurface trough which also houses the serially positioned drive means.

A base 12 of an inverted T-profile 13 is secured to the upwardly facing base of the inverted U-shaped undercarriage 7. The load receiver 16, which in the preferred embodiment is somewhat prism-shaped, is attached to the upwardly extending leg 14 of this T-profile 13. This load receiver 16 extends longitudinally in the conveying direction T over the entire length of the transport cart 1.

The guides 2 and 3 are embodied as C-shaped channels which are arranged in the subsurface trough extending parallel in the conveying direction and facing each other. These C-profiles 2 and 3 are each fastened by a leg at the bottom being secured on a base plate 19, while oppositely located upper legs 21 and 22 are each provided with a cover plate 23 and 24. The cover plates 23 and 24 are spaced at such a distance from each other that a longitudinal gap 26 of a width "b26", and which extends in the conveying direction T results. The upwardly extending leg 14 of the T-profile 13 extends up through this gap 26. The load receiver 16 projects above the cover plates 23 and 24.

A C-profile groove 27, which opens upwardly, is formed on the base plate 19 and is centered with respect to the guides 2 and 3 for guiding and supporting the drive means 4 and 6. The drive means 4 and 6 runs in this C-profile groove 27.

A transverse shaft 28 is rotatably seated in bearing blocks 29 and 31 underneath the base plate 19, as seen in FIG. 1. The shaft 28 is driven by a gear motor 32 and supports a reversing wheel 33 which is torsionally rigid and which is aligned with the drive means 4 and 6. As may be seen more clearly in FIG. 2, each of the drive means 4 and 6 includes an endless roller chain 38, and the reversing wheel 33 or 34. It will be understood that another similar reversing wheel will also be supported by a second transverse shaft, similar to shaft 28, at a second, remote end of each revolving drive 4 or 6.

Figure 2:
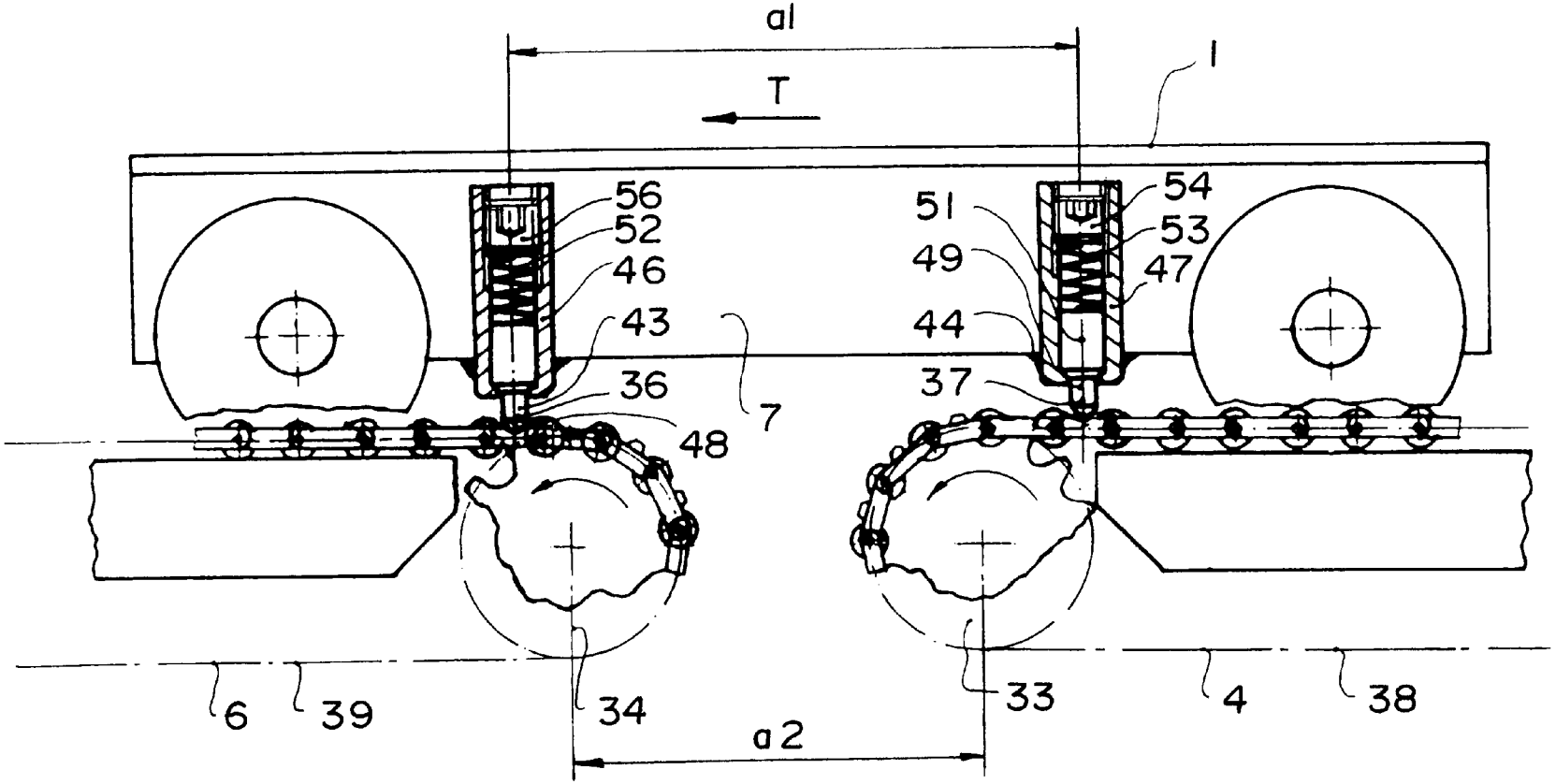
FIG. 2 is a schematic side-elevational of a first preferred embodiment of the conveying device.

The first drive means 4 terminates, as shown in FIG. 2, in a transition area in which the chain 38 is guided around the reversing wheel 33 underneath the base plate 19. The continuing second drive means 6 is disposed at a distance from the reversing wheel 33 of the first drive means 4. This second drive means 6 is reversed, extending from below the base plate 19, around a reversing wheel 34 to run in the conveying direction T. Both of the drive means 4 and 6 thus have endless drive belts or chains that have upper runs which extend in the same direction of travel so that a transport cart 1 will move in one direction as its drive is transferred from the first drive means 4 to the second, serially positioned and spaced downstream, in the direction of travel T of the transport cart 1, drive means 6.

At least one pusher, and in the first preferred embodiment of the present invention, two pushers 36 and 37 are arranged on the undercarriage 7 of the transport cart 1. These pushers 36 and 37 interlockingly engage first the drive means 4 and then the drive means 6 in such a way that in the transition area between the two drive means 4 and 6, at least one of the two pushers interlockingly engages one of the two drive means 4 and 6.

During a normal conveying process, during the movement of the transport cart 1 in the direction T, the pushers 36 and 37 interlockingly engage recesses in the drive means 4 or 6. The pushers 36 and 37 are seated so that they are movable in such a way that they can be moved out of a movement area of the drive means 4 or 6, to be taken out of engagement, for example for stopping the transport cart 1. As depicted in the exemplary embodiments, this movement of the pushers 36 and 37 can take place in that the drive means 4 and 6 exert a force, for example in case of an overload, such as when the transport cart 1 runs against an obstacle. It is also possible to uncouple the transport cart 1 from the driving means 4 and 6 by means of controllable devices, for example such as electric motors. The pushers 36 and 37 may also be taken out of engagement with the drive means 4 and 6 by means of remote-controlled electric motors, for example.

Because of differently sized loads, for example, the two drive means 4 and 6 can have transporting speeds which are different, for example, by ±10%, for example, v4=0.2 m/s, v6=0.22 m/s. The drive means 4 and 6 can be roller chains 38, 39, as represented in the first three exemplary embodiments, or toothed belts 41, 42, as shown in the fourth example.

In a first preferred embodiment of the conveying system of the present invention, as shown in FIG. 2, a first detent bolt 43, and a second detent bolt 44 are arranged on the undercarriage 7. These detent bolts 43 and 44, which act as the transport carriage pushers, are spaced apart from each other at a distance "a1", for example 571 mm, in such a way that while the second detent bolt 44 still engages the first roller chain 38, the first detent bolt 43 already engages the second roller chain 39. In order to be able to compensate for a possibly existing difference between the distances of two tooth gaps of the respective roller chain 37 and 38 and the distance "a1" between the detent bolts 43 and 44, both detent bolts 43 and 44 are resiliently arranged in such a way that at least one of the two detent bolts 43 and 44 can perform a movement approximately perpendicular with the conveying direction T. To this end, the detent bolts 43 and 44 are each displaceably seated in a guide bush 46 or 47 respectively which extends vertically with respect to the undercarriage 7 of the transport cart 1.

The distance "a1", of, for example 571 mm, between the two detent bolts 43 and 44 is greater than or equal to a distance "a2", of, for example 400 mm, between the axes of rotation of the reversing wheels 33 and 34 and corresponds, for example, to a multiple of a pitch of the drive means 4 and 6.

On their ends facing the upper runs of the roller chains 38 and 39, the detent bolts 43 and 44 are each provided with a rounded cap 48. Their second ends each have a collar 51, which acts as a stop against a restriction 49 formed at the lower end of the corresponding guide bush 46 or 47. A first end of a respective compression spring 52 or 54 pushes against this collar 51 of the detent bolt 43 or 44, and a second end of each spring acts on an adjustment screw 54 or 56. This adjustment screw 54 or 56 can be adjusted vertically in respect to the conveying direction T, so that the spring force acting on the detent bolts 43 and 44 can be set. This spring force effectively controls the retraction of each of the detent bolts 43 and 44 into their respective guide bushing 46 or 47. If the spring force is great, the detent bolts 43 and 44 will be less easily forced up into their associated sleeves 46 or 47.

Figure 3:
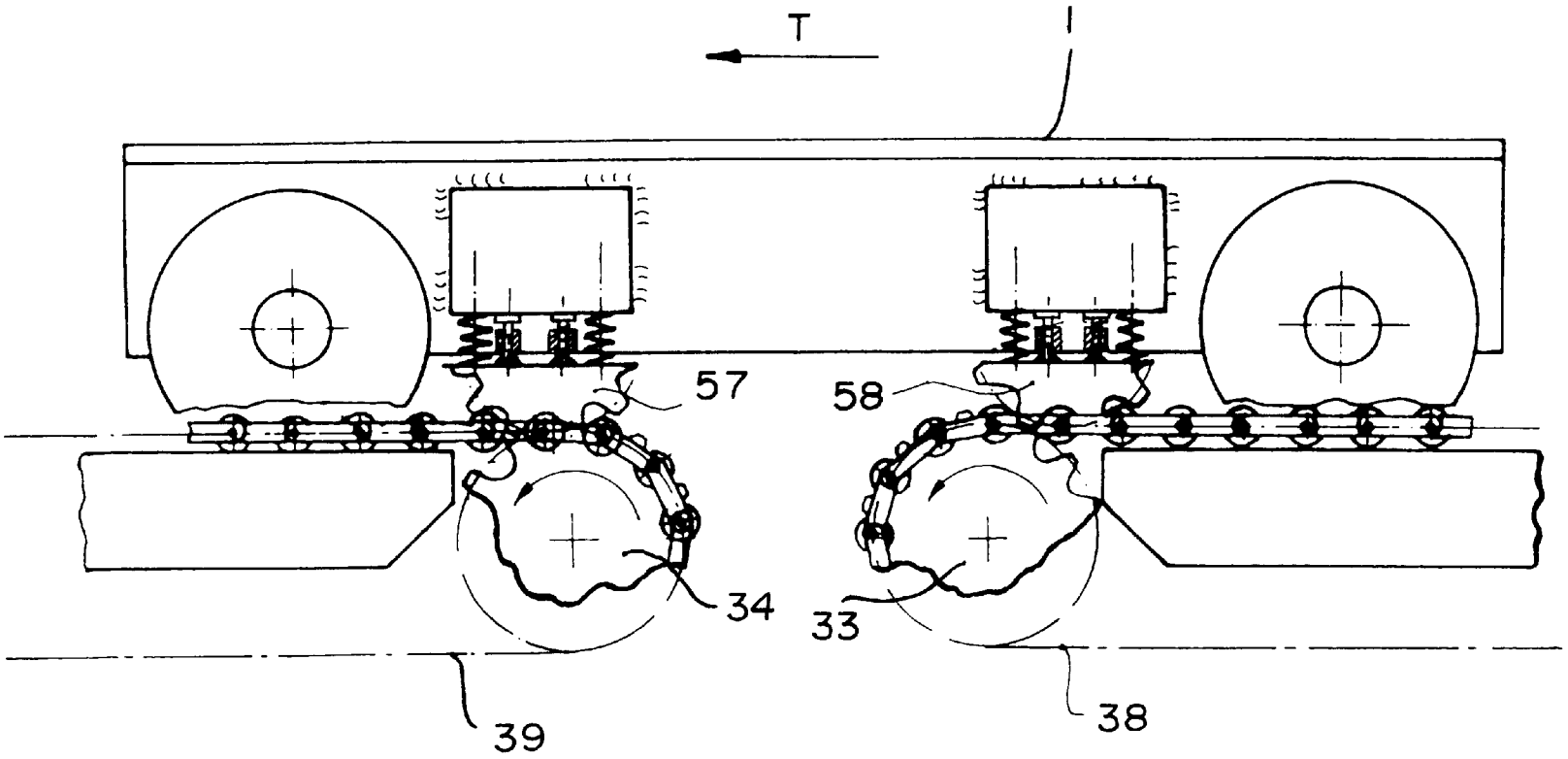
FIG. 3 is a schematic side-elevational view of a second preferred embodiment of the the conveying device.

Referring now to FIG. 3, there may be seen a second preferred embodiment of a conveying system in accordance with the present invention. In this second preferred embodiment, segments 57 and 58 of a chain wheel are used as the transport carriage pushers instead of the detent bolts 43 and 44. These segments 57 and 58 also interlockingly engage the corresponding roller chains 38 and 39 of the revolving drives 4 and 6. The spring force acting on these chain wheel segments 57 and 58 can be set. These segments 57 and 58 can be seated in guides, so they are displaceable vertically in respect to the conveying direction T, and immovable in the conveying direction T. As may be seen in FIG. 3 the downward force exerted against the upper runs of the roller chains 38 and 39 by these chain wheel segments 57 and 58 is controlled by the selection and utilization of appropriately sized springs, generally in a manner similar to that discussed in connection with the first preferred embodiment of the conveying system.

Figure 4:
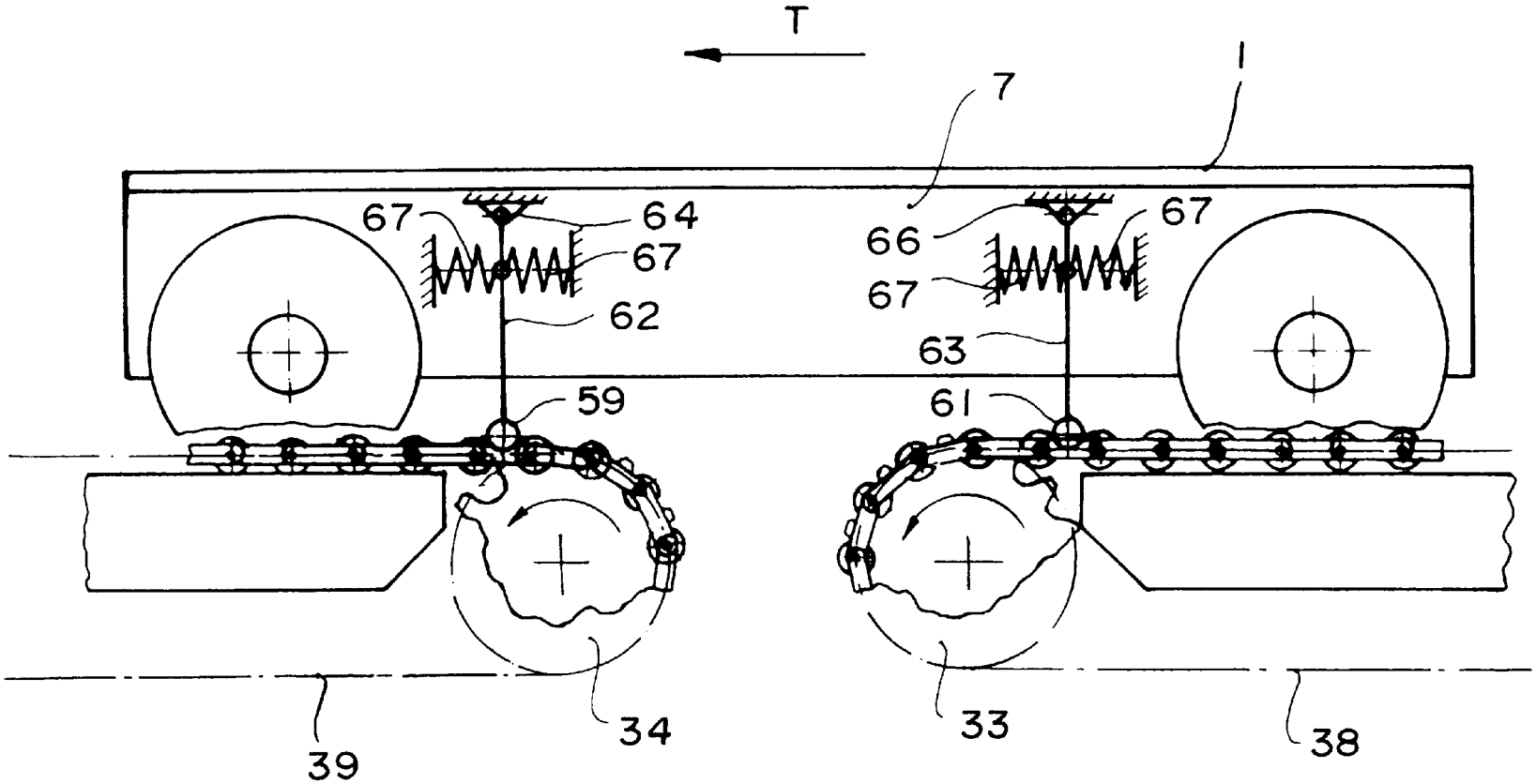
FIG. 4 is a schematic side-elevational view of a third preferred embodiment of the conveying device.

Turning now to FIG. 4, there may be seen a third preferred embodiment of a conveying system in accordance with the present invention. In this third preferred embodiment, there are provided generally cylinder-like pressure elements 59 and 61, whose longitudinal axes extend crosswise to the conveying direction T, and which are supported on the undercarriage 7 so that they are pivotable in the conveying direction T. For this purpose the end of a pivot lever 62 or 63 for each pressure element 59 or 61 is seated pivotably in the conveying direction T by means of a hinge 64 or 66. Each pressure element 59 or 61 is fastened on a second end of its associated one of the pivot levers 62 and 63. Each pivot lever 62 and 63 is resiliently fastened by means of adjustable pressure springs 67. As depicted in FIG. 4 pressure springs 67 can be interposed between the pivot levers 62 and 63 and suitable supports in both the forward as well as the rearward direction of travel of the transport cart 1. The selection of the spring forces for these springs 67 can exert a forward or a rearward bias on each of the pivot levers 62 or 63, or can maintain them in a neutral position.

Figure 5:
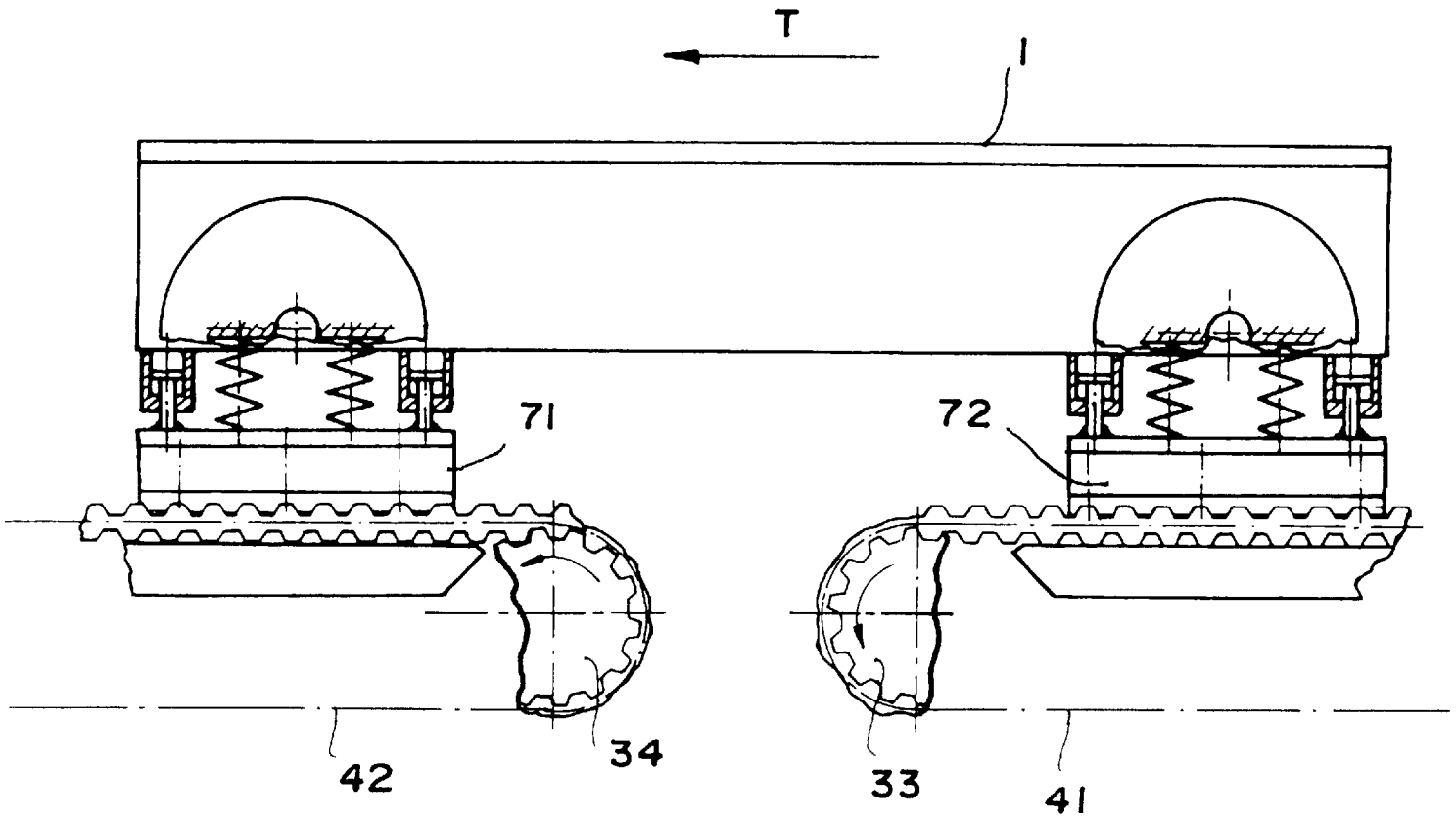
FIG. 5 is a schematic side-elevational view of a fourth preferred embodiment of the conveying device.

As may be seen by referring to FIG. 5, it is possible, in accordance with a fourth preferred embodiment of the present invention, to use toothed belt-like flat elements in place of the detent bolts 43 and 44 or the segments 57 and 58 of a chain wheel. In this fourth preferred embodiment of the conveying system of the present invention, the roller chains 38 and 39 of the revolving drives 4 and 6 are replaced by double sided toothed drive belts 41 and 42. The reversing wheels 33 and 34 can remain the same, or can be modified to specifically cooperate with the toothed belts 41 and 42. If these toothed belts 41 and 42 with teeth on both surfaces of the belts are provided as the revolving drives 4 and 6, then the pushers for the transport cart will be formed as flat toothed elements 71 and 72. These toothed elements 71 and 72 will have tooth shapes that cooperate with the tooth profiles of the toothed belts 41 and 42.

Figure 6:
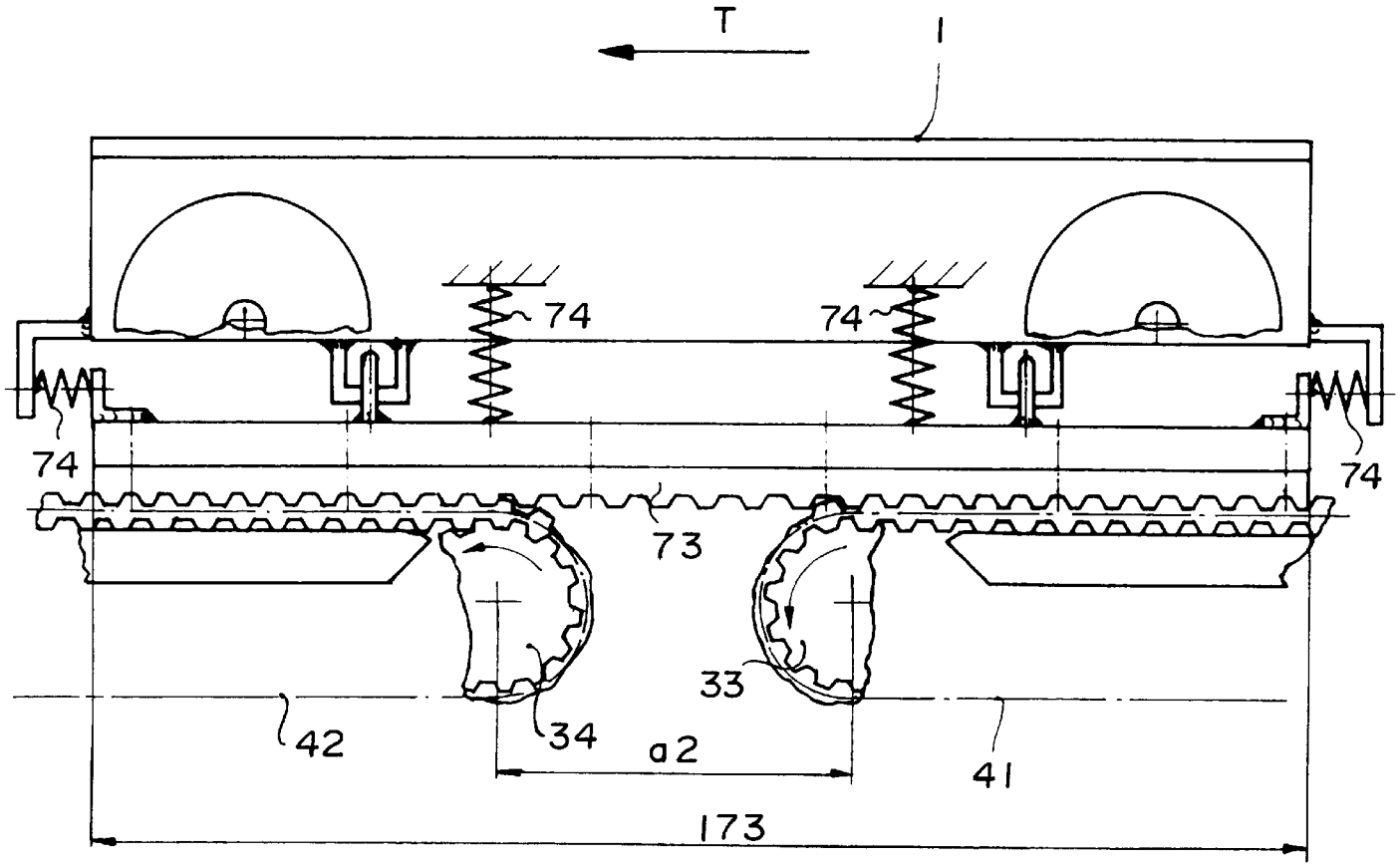
FIG. 6 is a schematic side-elevational view of a fifth preferred embodiment of the conveying device.

A fifth preferred embodiment of the conveying system, that is generally similar to the fourth preferred embodiment, is depicted in FIG. 6. In this fifth preferred embodiment, the two individual pushers 36 and 37, which are embodied as toothed belts or toothed belt segments can be connected with each other, so that a single continuous pusher 73 will be provided. As in the fourth preferred embodiment, this pusher 73 can be embodied as a toothed belt element 73 and is seated by means of adjustable compression springs 74 so that it is displaceable in the conveying direction T as well as vertically with respect to the conveying direction T. In the present configuration, the length l73 of the toothed belt element 73 is greater than the distance "a2" between the axes of rotation of the reversing wheels 33 and 34, all as may be seen by referring to FIG. 6. The various compression springs 74 will act to position the elongated transport cart pusher 73 both vertically and longitudinally, and will effect the amount of the force required to unseat the pusher 73 from the toothed belt or belts 41 and 42 in the event of blockage of the path of travel of the transport cart 1.

Figure 7:
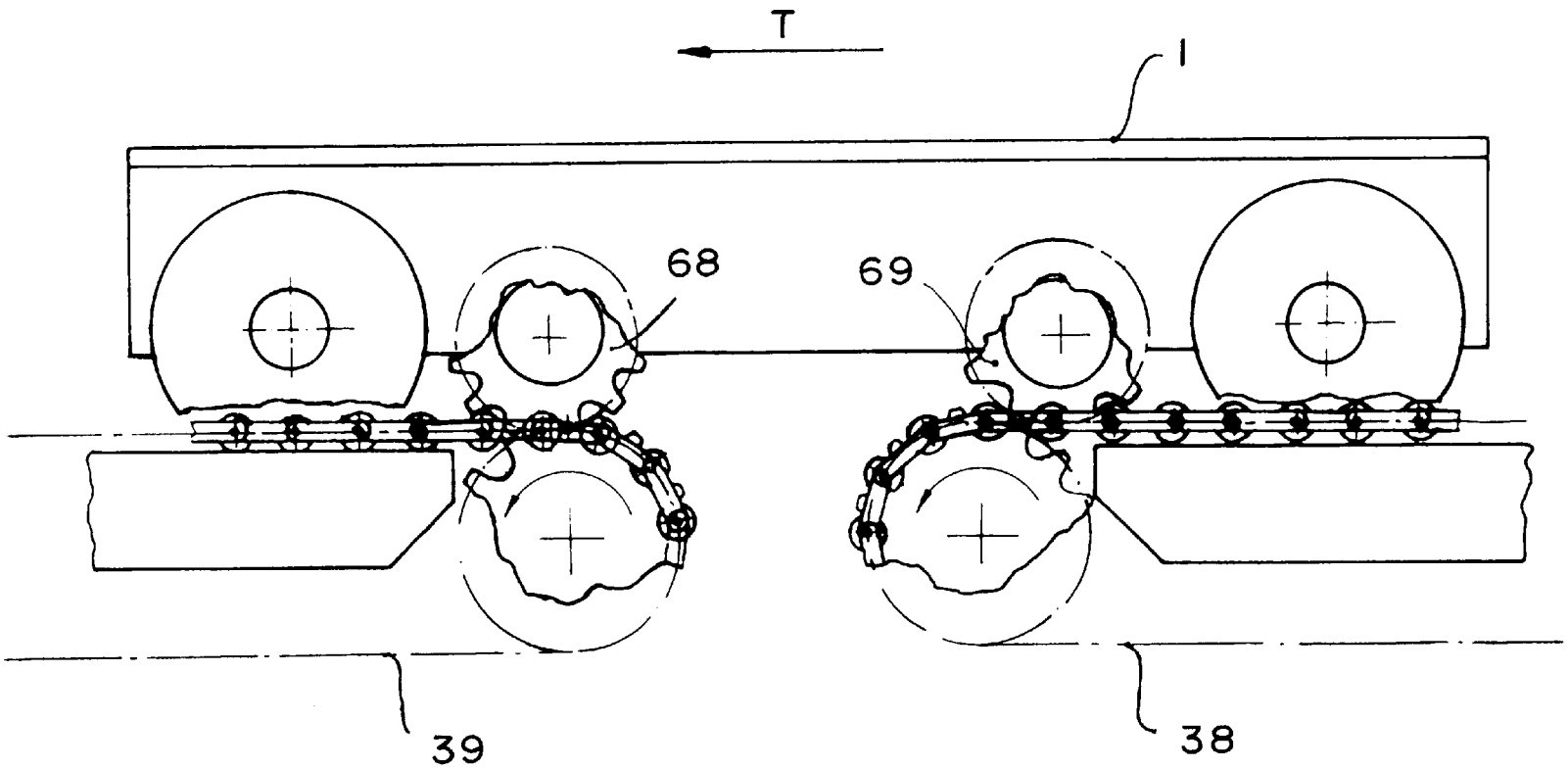
FIG. 7 is a schematic side-elevational view of a sixth preferred embodiment of the conveying device in accordance with the present invention.

In a sixth preferred embodiment of a conveying system of the present invention, as seen in FIG. 7, the pushers 68 and 69 are embodied as revolvable chain wheels 68 and 69 or as toothed belt wheels. These rotatable pushers 68 and 69 are each seated on the undercarriage 7 via a lockable coupling, so that they are rotatable over more than 360° and can be selectively connected, fixed against relative rotation, with the transport cart 1. During normal operation, the chain wheels 68 and 69 are connected fixed against relative rotation with the transport cart 1. A torque required in case of an overload, such as, for example may be encountered upon the transport cart 1 running up against an obstacle for rotation, or for the uncoupling of the respective chain wheel 68 or 69, can be set by means of the adjustable sliding coupling. However, it is also possible to couple or uncouple the revolving pushers 68 and 69 to or from the transport cart 1 by controllable means, for example electric motors. Because of this, the transport cart 1 can remain stopped even with the chains revolving. This is advantageous if several transport carts are conveyed by one drive means 4, 6.

The mode of operation of the conveying system in accordance with the present invention, as depicted, for example in the first preferred embodiment, is as follows:

The transport cart 1, as shown in FIG. 1, is conveyed in the conveying direction T. During this conveyance, preferably both pushers 36 and 37 simultaneously engage the first drive means 4. If now the transport cart 1 reaches the transition area between the first drive means 4, and the second drive means 6, the leading pusher 36 moves out of engagement with the first drive means 4. Because of the continuing movement of the transport cart 1, the first pusher 36 is brought into an entry area of the second drive means 6. If now the leading pusher 36 meets a tooth or a roller of the second drive means 6, instead of a tooth gap, the tooth or the roller presses the pusher 36 up against the force of spring 52 and out of the movement area of the second drive means 6. A further relative movement between the transport cart 1 and the second drive means 6 takes place, since either the transport cart 1 is conveyed at the transporting speed v4 by the second or trailing pusher 37 still engaged with the first drive means 4 or it is already out of engagement. In this transition area, the transport cart 1 has a transporting speed which is different from the transporting speed v6 of the second drive means 6. The first or leading pusher 36 is displaced to a tooth gap by this relative movement between the transport cart 1 and the second drive means 6 and engages this gap under the force of the spring 52. The first pusher 36 now interconnectingly engages the second drive means 6 and in this way drives the transport cart 1 in the transport direction T.

If, for example, the movement of the transport cart 1 becomes blocked by an obstacle, the pushers 36 and 37 are pushed out of the tooth gaps of the respective drive means 4 and 6 against the spring force. The drive means 4 and 6 continue to revolve while the transport cart 1 is stopped. In this way, the pushers 36 and 37 also act as a slide coupling, which operates independently to a large extent from the coefficient of friction. It will be understood that the operation of the first preferred embodiment of the conveying system discussed above is also applicable to the several other preferred embodiments. In each embodiment, the pusher or pushers will engage the revolving drive and can be disengaged from the drive in the event that the transport cart is impeded by an obstacle.

While a full and complete description of preferred embodiments of a conveying system in accordance with the present invention have been set forth fully and completely hereinabove, it will be apparent to one of skill in the art that a number of changes in, for example, the objects transported by the cart, the specific drives for the reversing wheels, the overall sizes of the transport cart and the like may be made without departing from the true spirit and scope of the present invention which is accordingly to be limited only by the following claims.

What is claimed is:

1. A conveying system for transporting a load comprising;

a transport cart;

a plurality of rollers supporting said transport cart;

roller receiving guides defining a path of travel of said transport cart;

a plurality of serially arranged drive means spaced along said path of travel of said transport cart, each of said plurality of serially arranged drive means having a plurality of recesses spaced apart along said path of travel at a pitch distance, each of said plurality of serially arranged drive means including reversing wheels, adjacent ones of said reversing wheels on said serially arranged drive means being spaced apart along said path of travel by a transition area having a first distance;

spaced pushers on said transport cart, said spaced pushers on said transport cart being spaced along said path of travel at a second distance, said second distance being greater than said first distance, and a multiple of said pitch distance, said spaced pushers engaging two of said drive means in said transition area; and a resilient support, said resilient support mounting said spaced pushers on said transport cart and providing a spring force for urging said spaced pushers into engagement with said spaced recesses on said drive means to drive said transport cart, said spaced pushers being disengageable from said spaced recesses against said spring force upon relative movement between said transport cart and said drive means in a transport direction of said transport cart.

2. The conveying system of claim 1 wherein said at least one pusher is supported for movement vertically with respect to said transport direction of said transport cart.

3. The conveying system of claim 1 wherein said at least one pusher is supported for movement with respect to said transport direction of said transport cart.

4. A conveying system for transporting a load comprising:

a transport cart;

a plurality of rollers supporting said transport cart;

roller receiving guides defining a path of travel of said transport cart;

first and second drive means each having a plurality of spaced recesses, each of said first and second drive means including reversing wheels, adjacent ones of said reversing wheels being spaced apart at a first distance; and first and second pushers on said transport cart, each of said first and second pushers being engageable with one of said spaced recesses on said drive means to drive said transport cart, and being disengageable from said one of said spaced recesses in response to movement of said drive means with respect to said transport cart, each of said first and second pushers on said transport cart being spaced at a second distance, said second distance being greater than said first distance, each of said drive means having a pitch distance, said second spacing distance being a multiple of said pitch distance.

* * * * *